US006282865B1

(12) United States Patent
Bergstrom et al.

(10) Patent No.: US 6,282,865 B1
(45) Date of Patent: Sep. 4, 2001

(54) APPARATUS FOR APPLYING DRINKING STRAWS

(75) Inventors: Jan-Ake Bergstrom, Loddekopinge; Jens Quist, Malmo; Jan Strandberg, Lomma; Johan Ohlund, Stockholm, all of (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/423,894

(22) PCT Filed: May 14, 1998

(86) PCT No.: PCT/SE98/00895

§ 371 Date: May 4, 2000

§ 102(e) Date: May 4, 2000

(87) PCT Pub. No.: WO98/51572

PCT Pub. Date: Nov. 19, 1998

(30) Foreign Application Priority Data

May 16, 1997 (SE) ..... 9701835

(51) Int. Cl.[7] ..... B65B 61/00

(52) U.S. Cl. ..... 53/128.1; 53/135.1; 53/520

(58) Field of Search ..... 53/135.1, 520, 53/128.1, 410, 412, 580; 156/358, 249

(56) References Cited

U.S. PATENT DOCUMENTS

| | | | | |
|---|---|---|---|---|
| 4,121,401 | * | 10/1978 | Duerr et al. | 53/580 |
| 4,233,331 | * | 11/1980 | Lemke et al. | 53/412 |
| 4,293,369 | | 10/1981 | Dilot et al. | 156/521 |
| 4,372,797 | | 2/1983 | Dilot et al. | 156/249 |
| 4,384,915 | | 5/1983 | Utsumi | 156/499 |
| 4,535,584 | * | 8/1985 | Tsubota | 53/128.1 |
| 4,584,046 | | 4/1986 | Geyssel | 156/358 |
| 4,584,819 | | 4/1986 | Hakansson | 53/410 |
| 4,778,053 | | 10/1988 | Hakansson | 206/443 |
| 4,903,458 | | 2/1990 | Hakansson | 53/410 |
| 4,969,308 | | 11/1990 | Hakansson | 53/410 |
| 5,037,366 | * | 8/1991 | Yokoyama | 53/410 |

FOREIGN PATENT DOCUMENTS

WO 98/51572 11/1998 (WO) .

* cited by examiner

*Primary Examiner*—Peter Vo
*Assistant Examiner*—Sam Tawfik
(74) *Attorney, Agent, or Firm*—Burns, Doane, Swecker & Mathis, L.L.P.

(57) ABSTRACT

The invention relates to an apparatus for applying drinking straws on prefabricated packaging containers. The apparatus includes a rotary drive means for advancing drinking straws which are guided in towards the drive means wrapped in protective envelopes, and continuously disposed as drinking straw belts. The apparatus also includes guides for drinking straws belts and drinking straws, and a device for separating drinking straws from the belt, and a device for applying the drinking straw on the side wall of the packaging container. The drive means of the apparatus routes continuously, and the device for separating drinking straws from the belt is disposed to accompany a part distance of the rotation of the drive means, this movement being realised by means of a cam and a cam roller cooperating therewith. The apparatus further includes a continuously driven conveyor on which the packaging containers are advanced so that one passes the drive means. The device for applying drinking straws to the side wall of the packaging container is disposed to accompany a part distance of the movement of the conveyor belt. The accompanying movement is realised in that the applicator device is journaled in two eccentric shafts.

9 Claims, 1 Drawing Sheet

APPARATUS FOR APPLYING DRINKING STRAWS

FIELD OF THE INVENTION

The present invention relates to an apparatus for applying drinking straws to prefabricated packaging containers, comprising a rotary drive means for continuous belts of drinking straws wrapped in protective envelopes, guides for drinking straw belts and drinking straws, a conveyor for the packaging containers, a device for separating the drinking straws from the belt, and a device for applying the drinking straw to the side wall of the packaging container.

BACKGROUND OF THE INVENTION

Many single-use disposable packages for drinks are manufactured in so-called portion volumes, intended to be consumed direct from the package. The majority of these packages are provided with drinking straws in a protective envelope which is secured to the one side wall of the packaging container. The packages, which are preferably parallelepipedic in shape, are manufactured from a laminate with a core of paper or paperboard, with different layers of thermoplastics and possibly aluminium foil. On the one wall of the packaging container—most often the top wall—a hole has been punched out in the core layer and this hole is covered by the other layers of the laminate, which makes it possible to penetrate the hole with the drinking straw which accompanies the packaging container, and hereby consume the drink enclosed in the package.

There have long been machines which apply drinking straws in their protective envelopes to packaging containers which are conveyed through the machine. Such a machine is, for example, described in Swedish Patent Specification SE-424 847. These machines function in that a belt of continuous drinking straw envelopes with drinking straws is guided in towards and surrounds a drive means. Adjacent the drive means, there are devices for severing the drinking straw belt into individual drinking straws enclosed in a protective envelope, as well as devices for applying the drinking straw to one side wall of the packaging container, the packaging container being advanced on a conveyor through the machine. Prior to the moment of application, the packaging container is provided with securement points. The securement points may, for example, consist of hot melt, which is molten glue which glues the drinking straw envelope in place and retains it when the glue has hardened. In order to be able to separate each drinking straw and apply the drinking straw on the package, the drive means must operate intermittently and the conveyor must advance the packages intermittently each time application is put into effect.

With new, more rapid filling machines in which the parallelepipedic packaging containers are manufactured, demands have also been raised for the development of more rapid machines for applying the drinking straws. The new machines must be able to operate at at least the same speed as the filling machines in order to avoid bulky and costly accumulation equipment which would otherwise be necessary.

SUMMARY OF THE INVENTION

One object of the present invention is to realise a machine for applying drinking straws to packaging containers which operates more rapidly in that the drive means and the conveyor can operate continuously.

SOLUTION

The above mentioned objective and other objectives are achieved by providing an apparatus for applying drinking straws to prefabricated packaging containers including a rotary drive means for continuous belts of drinking straws wrapped in protective envelopers, guides for drinking straw belts and drinking straws, a conveyor for the packaging containers, a device for applying the drinking straw to the side wall of the packaging container. The device for separating the drinking straws is disposed to accompany a first portional distance of the rotation of the drive means during which the conveyor is driven continuously; and that the device for applying drinking straws is disposed to accompany a second portional distance of the movement of the conveyor belt.

BRIEF DESCRIPTION OF THE DRAWING

One preferred embodiment of the present invention will now be described in greater detail hereinbelow, with reference to the accompanying Drawing, in which.

Figure 1:
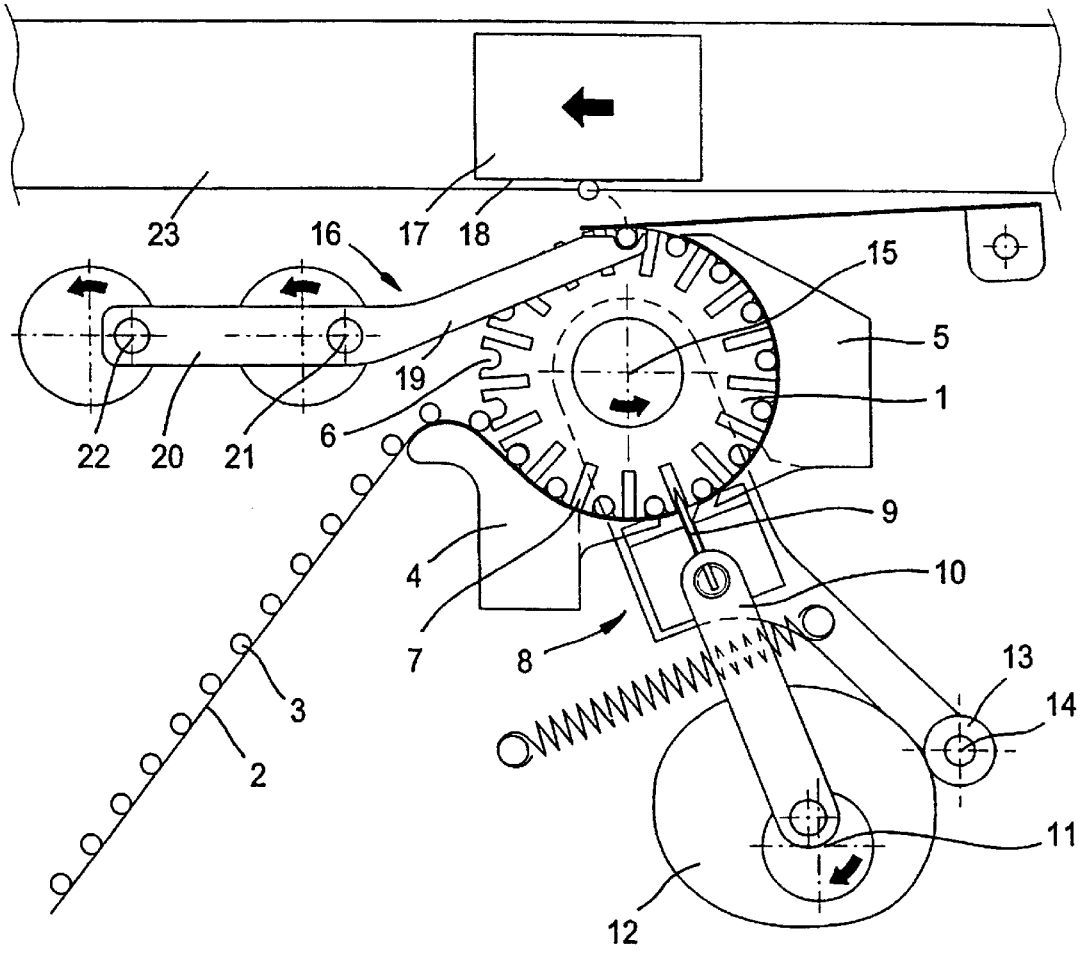
FIG. 1 is a detailed illustration, in plan view, of the central parts of the apparatus according to the present invention.

The Drawing shows only those details essential to an understanding of the present invention, and the remaining parts of the applicator machine which are well-known to a person skilled in the art have been omitted.

DETAILED DESCRIPTION OF THE INVENTION

FIG. 1 shows the central parts of the apparatus with the components included, which are essential for the function of the apparatus. The apparatus comprises a drive means 1, a so-called feeder wheel. A continuous belt 2 of drinking straws 3 is advanced to the drive means 1 in protective envelopes. The drinking straws 3 are advanced via guides (not shown) as well as guides 4 and 5 surrounding the drive means 1 and which retain the drinking straw belt 2 and the drinking straw 3 against the drive means 1.

On its circumferential surface, the drive means 1 has a number of recesses 6 which are each intended for one drinking straw 3. The number of recesses 6 on the drive means 1 depends on the thickness and design of the drinking straw 3. Thus, a drive means 1 intended for straight or telescopic drinking straws 3 may have seventeen recesses 6 on its surface, while a drive means 1 for U-shaped drinking straws 3 may have twelve recesses 6. Other distributions of the recesses may also occur.

Between each recess 6 on the circumferential surface of the drive means 1, there is disposed a groove 7. The groove 7 is intended to receive a device 8 for separating the drinking straws 3 from the drinking straw belt 2. The device 8 for separating the drinking straws 3 is in the form of a knife 9 fixedly mounted in a holder 10. The knife 9 with its holder 10 is secured on an eccentric shaft 11. The eccentric shaft 11 is connected to a cam 12 against which a cam roller 13 acts. The cam roller 13 is centred on a fixed shaft 14. The entire device 8 for separating drinking straws 3, with the knife holder 10 and cam roller 13 is journalled in the centrepoint 15 of the drive means 1.

The apparatus further includes a device 16 for applying a drinking straw 3 on one side wall 18 of a packaging container 17. The applicator device 16 includes one or preferably two arms 19. With two cooperating applicator arms 19, a more reliable and efficient placing of the drinking straws 3 on the side wall 18 of the packaging containers 17 will be obtained. The arms 19 are oriented above one another and are united by means of a bracket 20, which may in principle consist of an extension of the applicator arms 19. The bracket 20 is eccentrically journalled in two shafts 21, 22 which have the same eccentricity. Parallel grooves (not shown) are provided in the drive means 1 in which the applicator arms 19 move.

The apparatus also includes a conveyor 23 passing through the apparatus for conveying the packaging containers 17 which are to be supplied with drinking straws 3. The conveyor 23 may consist of an endless, driven belt.

The moving parts included in the apparatus, i.e. the drive means 1, the separator device 8 and the applicator device 16 are mechanically interconnected and driven by a motor (not shown), e.g. a servo motor. The servo motor drives the apparatus via belt and/or cog gears. The conveyor belt 23 has a speed which is adapted to the other components included in the apparatus. The entire apparatus is designed such that it may variably inclined, so that the packaging containers 17 which are advanced placed straight on the conveyor belt 23 will have the drinking straws 3 placed in the desired angle of inclination on the packaging container 17. The inclination depends on both the volume of the packaging container 17 and on the size and shape of the drinking straw 3.

The drive means 1 which is disposed to rotate continuously is the central unit in the apparatus. It is the drive means 1 which transports the drinking straws 3 round from when the continuous belt 2 of drinking straws 3 wrapped in protective envelopes reaches the apparatus via a number of guides (not shown), around the circumferential surface of the drive means 1, past the separator device 8 to the applicator device 16. The drive means 1 moves with a gear ratio from the servo motor which depends on the number of recesses 6 on the circumferential surface of the drive means 1. The drive means 1 rotates one division, i.e. one recess 6 for each packaging container 17 which passes the drive means 1. For example, a drive means 1 for straight drinking straws 3 may have a gear ratio of 17:1 and a drive means 1 for U-shaped drinking straws may have a gear ratio of 12:1.

The device 8 for separating the drinking straws 3 from the belt 2 executes two separate movements during each separation sequence. On the one hand, the knife 9 must reciprocate radially in relation to the drive means 1 and into the groove 7 in order to be able to separate one drinking straw 3 from the belt 2. This movement is realised by means of the eccentric shaft 11 on which the knife 9 in its holder 10 is secured. On the other hand, the separator device 8 must accompany the continuously rotating drive means 1 during that time when the separation sequence is in progress. This movement is achieved by means of the cam 12 and the cam roller 13 cooperating therewith. Once the separation sequence is completed and the knife 9 has severed one drinking straw 3 in its protective envelope from the continuous belt 2, the separator device 8 returns to its starting position and there awaits a new separation sequence.

The conveyor 23 moves tangentially in relation to the drive means 1 and conveys, through the apparatus, the packaging containers 17 which are to be provided with drinking straws 3. The conveyor 23 moves at a speed which is synchronised with the speed of the remaining components included in the apparatus. Before the packaging containers 17 arrive at the drive means 1, they have been provided, on their side surface 18, with securement points, preferably two in number, which may, for example, consist of so-called hot melt. The securement points are to glue in place and, once the hot melt glue has set, retain the drinking straw 3 in its protective envelope against the side wall 18 of the packaging container 17.

The device 16 for applying drinking straws 3 on the side walls 18 of the packaging containers 17 describes, by means of the two eccentric shafts 21, 22, a circular or alternatively elliptic movement so that the arms 19 move in towards the drive means 1 and entrap a drinking straw 3. The drinking straw 3 is moved by the rotating movement towards the side wall 18 of the packaging container 17 and is applied against the securement points. As a result of the servo motor and requisite gear ratios, the applicator arms 19 now move at the same speed at which the conveyor 23 (and thereby also the packaging container 17) moves, and the applicator arms 19 accompany, in their rotating movement, the packaging container 17 and the conveyor 23 a short distance before the rotational movement recuperates the applicator arms 19 back to their starting position where they await a new application sequence.

Alternatively, the device 16 for applying drinking straws 3 may consist of an endless, driven belt which collects the drinking straw 3 on the surface of the drive means 1 and presses it against the side wall 18 of the packaging container 17 during a brief period of time when the belt runs parallel with and at the same speed as the conveyor 23 on which the packaging containers 17 are advanced.

Alternatively, an apparatus according to the present invention may be employed for applying other objects such as, for example, spoons or the like which are intended to accompany the package 17 to the consumer.

As will have been apparent from the foregoing description, the present invention realises an apparatus for applying drinking straws 3 on packaging containers 17 at a high speed since both the drive means 1 and the conveyor 23 move continuously.

The present invention should not be considered as restricted to that described above and shown on the Drawing, many modifications being conceivable without departing from the scope of the appended Claims.

What is claimed is:

1. An apparatus for applying straws to prefabricated packaging containers, comprising a rotary drive means for continuous belts of drinking straws wrapped in protective envelopes, guides for drinking straw belts and drinking straws, a conveyor for the packaging containers, a device for separating the drinking straws from a belt, and a device for applying the drinking straws to the side wall of the packaging containers, wherein the drive means rotates continuously; the device for separating the drinking straws is disposed to accompany a first portional distance of the rotation of the drive means; the conveyor is driven continuously; and the device for applying drinking straws is disposed to accompany a second portional distance of the movement of the conveyor belt.

2. The apparatus as claimed in claim 1, wherein the device for separating drink straws comprises a knife and a holder therefor, secured on an eccentric shaft; and that a cam with a cooperating cam roller is disposed to realise the movement accompanying the rotation of the drive means.

3. The apparatus as claimed in claim 1, wherein the device for applying drinking straws comprises two arms connected by a bracket which is journalled to two eccentric shafts.

4. The apparatus as claimed in claim 3, wherein both shafts have the same eccentricity.

5. The apparatus as claimed in claim 3, wherein the two arms, on the occasion of the application, are disposed to move at a speed which is adapted to the speed of the conveyor.

6. The apparatus as claimed in claim 1, wherein the drive means, the device for separating drinking straws and the device for applying drinking straws are mechanically interconnected.

7. The apparatus as claimed in claim 1, wherein the drive means has on its circumferential surface a number of recesses, each one of which being intended to receive a drinking straw.

8. The apparatus as claimed in claim 7, wherein the drive means rotates a distance of one recess for each packaging container which passes the drive means.

9. The apparatus as claimed in claim 1, wherein the device for applying drinking straws comprises at least one arm which is connected to a bracket which is journalled to two eccentric shafts.

* * * * *